United States Patent [19]

Huang et al.

[11] Patent Number: 4,702,314

[45] Date of Patent: Oct. 27, 1987

[54] PATTERNS OF HORIZONTAL AND VERTICAL WELLS FOR IMPROVING OIL RECOVERY EFFICIENCY

[75] Inventors: Wann-Sheng Huang; Margaret A. Hight, both of Houston, Tex.

[73] Assignee: Texaco Inc., White Plains, N.Y.

[21] Appl. No.: 835,702

[22] Filed: Mar. 3, 1986

[51] Int. Cl.[4] ..... E21B 43/30

[52] U.S. Cl. ..... 166/245; 166/268; 166/50

[58] Field of Search ..... 166/245, 268, 50

[56] References Cited

U.S. PATENT DOCUMENTS

| | | | |
|---|---|---|---|
| 3,794,113 | 2/1974 | Strange | 166/245 |
| 4,160,481 | 7/1979 | Turk et al. | 166/50 |
| 4,257,650 | 3/1981 | Allen | 166/50 |
| 4,283,088 | 8/1981 | Tabakov et al. | 166/272 |
| 4,296,969 | 10/1981 | Willman | 166/50 |
| 4,390,067 | 6/1983 | Willman | 166/245 |
| 4,466,485 | 8/1984 | Shu | 166/50 |
| 4,522,260 | 6/1985 | Wolcott, Jr. | 166/50 |
| 4,598,770 | 7/1986 | Shu et al. | 166/245 |

*Primary Examiner*—Stephen J. Novosad
*Assistant Examiner*—Bruce M. Kisliuk
*Attorney, Agent, or Firm*—Jack H. Park; Kenneth R. Priem; Harold J. Delhommer

[57] ABSTRACT

The invention is a method of recovering hydrocarbons from an underground formation by employing a modified 5 spot or 9 spot well pattern which contains a substantially vertical central well and four substantially horizontal wells, each having one end located relatively near the center of a substantially rectangular well pattern and the other ends located relatively near each of the corners of the well pattern. Preferably, the well pattern will also contain four substantially vertical corner wells located approximately at the four corners of the substantially rectangular modified 5 spot or 9 spot well pattern.

9 Claims, 5 Drawing Figures

PATTERNS OF HORIZONTAL AND VERTICAL WELLS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with modified 5 spot and 9 spot well patterns employing at least four horizontal wells, each having one end located near a vertical central well and the other end located near each of the corners of a substantially rectangular well pattern.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unsually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a method of recovering hydrocarbons from an underground formation by employing a modified 5 spot well pattern which contains a substantially vertical central well and four substantially horizontal wells, each having one end located relatively near the center of a substantially rectangular well pattern and the other ends located relatively near each of the corners of the well pattern. Preferably, the well pattern will also contain four substantially vertical corner wells located approximately at the four corners of the substantially rectangular modified 5 spot well pattern.

The invention pattern may also be expanded to a modified 9 spot pattern by the inclusion of four substantially vertical side wells located relatively near the boundaries of the substantially rectangular well pattern and between the corner wells. Four additional substantially horizontal wells may also be located between the vertical central well and the side wells.

DETAILED DESCRIPTION

Figure 1:
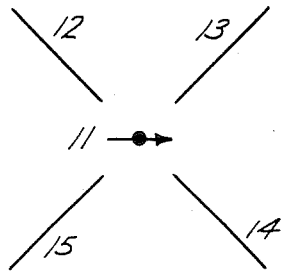
FIG. 1 illustrates an invention well pattern for a modified 5 spot well pattern containing a vertical central well and four horizontal wells.

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns to increase oil recovery.

The invention method provides a way of achieving horizontal well advantages by using substantially horizontal wells in conjunction with substantially vertical wells for improving oil recovery efficiency. The invention requires that a substantially vertical central well be located at approximately the center of a substantially rectangular modified 5 spot well pattern. Four substantially horizontal wells are drilled so that each horizontal well has one end located relatively near the vertical central well and the other end located relatively near each of the four corners of the substantially rectangular well pattern. Preferably, four substantially vertical corner wells will be located at the four corners of the substantially rectangular well pattern.

An alternate embodiment employs four additional substantially horizontal wells, each having one end located relatively near the vertical central well and the other end located between two corners of the substantially rectangular well pattern. This pattern embodiment may optionally contain four vertical corner wells.

The invention well pattern may be expanded to a modified 9 spot well pattern by locating four substantially vertical side wells relatively near the boundaries of the substantially rectangular pattern and between the corner wells. In another alternate embodiment, four additional substantially horizontal wells may be added to the modified 9 spot well pattern to give a total of eight horizontal wells. These horizontal wells should have one end located relatively near the vertical central well and the other end located relatively near the vertical side wells.

Optionally, more than one substantially vertical well may be located at approximately the center of the substantially rectangular well pattern. Since the vertical central well is most preferably a central injection well, it may be desirable to employ multiple central injection wells. Additional central injection wells may be especially desirable in tight formations where fluid injectivity is a problem.

Formation characteristics and existing vertical wells may require that the pattern be shaped roughly like a quadrilateral without ninety degree angles. Such patterns are intended to be encompassed within the phrase "substantially rectangular pattern".

The substantially vertical central well may be either an injection well or a production well, but is preferably an injection well. The horizontal wells, vertical corner wells and vertical side wells are preferably production wells, but may also be employed as injection wells. In thermal recovery operations, it is particularly preferred to inject a thermal fluid into wells prior to placing the wells on production in order to treat the formation in the immediate vicinity of the future production wells. Various flooding schemes may also be employed in which these wells may be alternately production and injection wells. The vertical and horizontal wells are preferably completed in the bottom third, most preferably, the bottom fifth of the hydrocarbon bearing formation.

The horizontal and vertical wells are all located, or at least perforated, so that a sufficient distance exists between the perforation intervals of each of the horizontal wells and the substantially vertical corner and central wells to prevent direct communication between the different wells. Preferably, the sufficient distance is at least 30 feet of undrilled formation. Large thief zones or fractures will preferably not run between the perforated intervals of nearby horizontal and vertical wells. Consequently, care must be taken to avoid locating perforations of producing horizontal wells too near the injection well or wells.

A significant advantage of the invention well pattern is that many of the horizontal wells may be drilled and completed from a common horizontal well pad. Thus, drilling costs are greatly reduced. For instance, the four horizontal wells of the FIGS. 1, 2 and 3 embodiments and the eight horizontal wells of the FIGS. 4 and 5 embodiments may all be drilled and completed from a single, centrally located horizontal well pad. When the pattern is duplicated over additional acreage, horizontal well pads can also be set up relatively near the location of the corner wells for drilling multiple horizontal wells. When the pattern of FIG. 3 is duplicated, a horizontal well pad set up near well 18 would be able to drill well 14 as well as three other horizontal wells.

Figure 2:
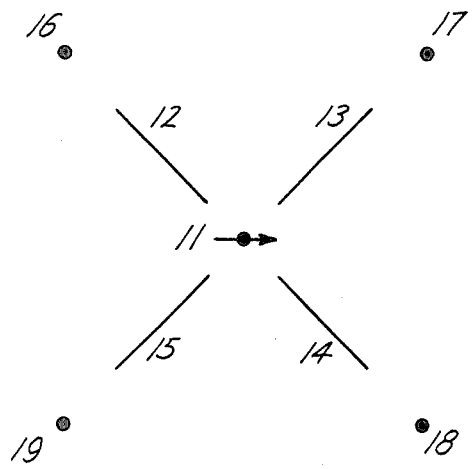
FIG. 2 illustrates another invention well pattern for a modified 5 spot well pattern containing four horizontal wells and four vertical corner wells.
Figure 3:
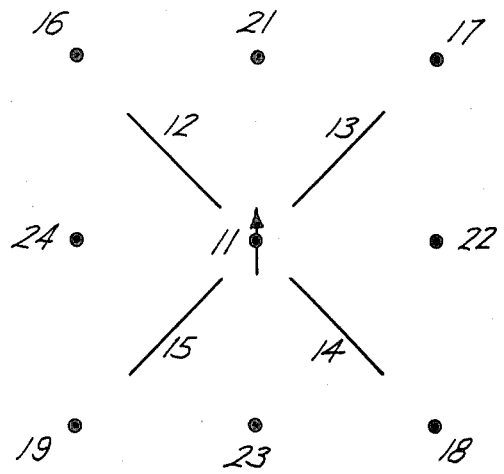
FIG. 3 illustrates an invention well pattern for a modified 9 spot well pattern.

FIGS. 1, 2, 3, 4, 5 and 6 diagram the invention drilling and production patterns. FIGS. 1 and 2 show the preferred modified 5 spot well pattern which comprises a substantially vertical central injection well 11 located at approximately the center of the substantially rectangular well pattern, and horizontal wells 12, 13, 14 and 15. Vertical corner wells 16, 17, 18 and 19 are shown in FIGS. 2 and 3. FIG. 3 shows the modified 9 spot well pattern on the invention containing vertical side wells 21, 22, 23 and 24. For some patterns, particularly patterns covering a large area, it may be desirable to substitute several vertical injection wells for the single central injection well 11 and locate the plural central injectors near the center of the pattern.

Figure 6:
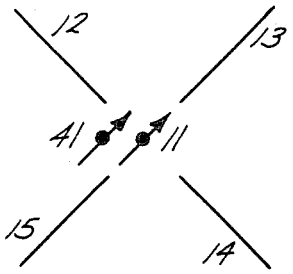
FIG. 6 illustrates the FIG. 1 embodiment containing a second vertical central injection well.

FIG. 6 shows an alternate embodiment of FIG. 1, wherein the pattern contains a second vertical central injection well 41.

Figure 4:
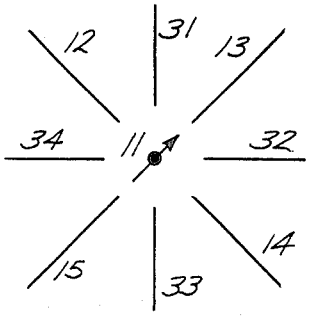
FIG. 4 illustrates an alternate embodiment with a vertical central injection well and eight horizontal wells.
Figure 5:
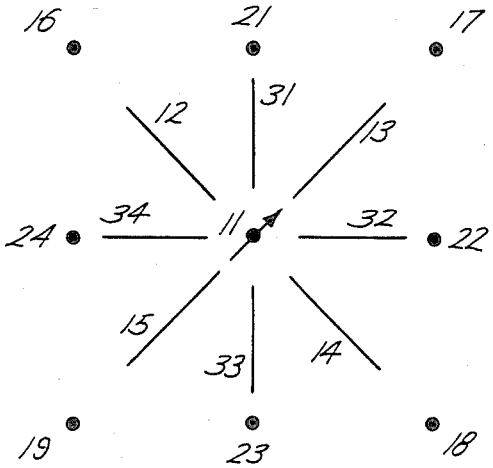
FIG. 5 illustrates an embodiment of the modified 9 spot well pattern containing eight horizontal wells.

FIGS. 4 and 5 show alternate embodiments with eight substantially horizontal wells. Horizontal wells 31, 32, 33 and 34 are added with one end located near the vertical central well 11 and the other end located between two corners of the substantially rectangular well pattern.

Simulation results indicate that the use of horizontal wells in conjunction with vertical wells according to the invention are highly effective in recovering oil, particularly oil from blind spot areas in mature steam floods. The horizontal wells speed oil recovery and thus, shorten project lives. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells and their perforation intervals are not critical, except that such factors will affect the well spacing and the economics of the process. Perforation size and density will be a function of factors such as flow rate, temperatures and pressures employed in a given operation. Such decisions should be determined by conventional drilling criteria, the characteristics of the specific formation, the economics of a given situation, and the well known art of drilling horizontal wells.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific Software-Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9 spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

One embodiment of the invention was simulated by taking the modified 5 spot of FIG. 2 and changing corner wells 16, 17, 18 and 19 to injection wells. The number of effective wells is two vertical injectors and four horizontal producers per pattern.

The run was carried out by simulating one-eighth of an 18.5 acre (7.5 ha) pattern with a total steam injection rate at the center and corner wells of 2400 BPD. All horizontal wells were completed in the bottom (5th layer) of the simulation grid. The horizontal wells had a length of 317 feet and a diameter of 6 inches.

Ultimate recovery was 72.5% of the original oil in place after a project life of 15 years. The pattern resulted in exceptional oil recovery in the early years of the simulation. After only ten years, 64.7% of the original oil in place was produced. The recovery of greater amounts of oil at a sooner time is a significant advantage of this pattern. But early steam breakthrough at the producing horizontal wells can be a problem. Thus, care must be taken to allow for a sufficient distance of undrilled formation between injection and production wells.

Many variations of the method of this invention will be apparent to those skilled in the art from the foregoing discussion and examples. Variations can be made without departing from the scope and spirit of the following claims.

TABLE 1

| RESERVOIR AND FLUID PROPERTIES - SIMULATION OF EXAMPLES 1-2 | |
|---|---|
| Porosity, fraction | 0.39 |
| Initial Fluid Saturations, Fraction: | |
| Oil | 0.589 |
| Water | 0.411 |
| Gas | 0 |
| Initial Reservoir Temperature, °F.(°C.) | 100 (37.7) |
| Initial Reservoir Pressure, psi (kPa) | 50 (345) |
| Permeability, md: | |
| Horizontal ($\mu m^2$) | 3000 (3) |
| Vertical ($\mu m^2$) | 900 (0.9) |
| Reservoir Thermal Conductivity, Btu/day-ft-°F. (W/m-°C.) | 31.2 (2.25) |
| Reservoir Heat Capacity, Btu/$ft^3$-°F. (kJ/$m^3$-°C.) | 37.0 (2481) |
| Cap and Base Rock Thermal Conductivity, Btu/day-ft-°F. (W/m-°C.) | 24.0 (1.73) |
| Cap and Base Rock Heat Capacity, Btu/$ft^3$-°F. (kJ/$m^3$-°C.) | 46.0 (3085) |

| Oil Viscosity, | cp @ °F. | Pa.s @ °C. |
|---|---|---|
| | 1230 @ 100 | 1.23 @ 37.7 |
| | 10 @ 300 | 0.01 @ 148.9 |

TABLE 1-continued

| RESERVOIR AND FLUID PROPERTIES - SIMULATION OF EXAMPLES 1-2 | |
|---|---|
| 3.99 @ 400 | 0.00399 @ 204.4 |
| Quality of Injected Steam, fraction (at sand face) | 0.65 |
| Residual Oil Saturation, Fraction | |
| to water: | 0.25 |
| to steam: | 0.15 |

What is claimed is:

1. A method of recovering hydrocarbons from an underground formation by employing a modified 5 spot well pattern, which comprises:

a substantially vertical central injection well located at approximately the center of a substantially rectangular modified 5 spot well pattern; and four substantially horizontal production wells, each horizontal well having one end located relatively near the vertical central well and the other end located relatively near each of the four corners of the substantially rectangular well pattern, said wells perforated so that at least 30 feet of distance exists between perforation intervals of different wells.

2. The hydrocarbon recovery method of claim 1, further comprising at least one more substantially vertical well located at approximately the center of the substantially rectangular well pattern.

3. The hydrocarbon recovery method of claim 1, further comprising substantially vertical corner production wells located relatively near the corners of the substantially rectangular well pattern, and substantially vertical production wells located as side wells relatively near the boundaries of the substantially rectangular well pattern and between the corner production wells.

4. The hydrocarbon recovery method of claim 3, further comprising an additional four substantially horizontal production wells, each horizontal well having one end located relatively near the vertical central well and the other end located relatively near each of the four vertical side wells.

5. The hydrocarbon recovery method of claim 1, further comprising an additional four substantially horizontal production wells, each horizontal well having one end located relatively near the vertical central well and the other end located between two corners of the substantially rectangular well pattern.

6. The hydrocarbon recovery method of claim 1, wherein the four substantially horizontal wells are drilled from a single well pad located relatively near the center of the substantially rectangular well pattern.

7. The hydrocarbon recovery method of claim 1, wherein the substantially horizontal wells are completed in the bottom fifth of the formation.

8. The hydrocarbon recovery method of claim 1, wherein the substantially vertical well is completed in the bottom third of the formation.

9. A method for recovering hydrocarbons from an underground formation by employing a modified 5 spot well pattern, which comprises:

one or more substantially vertical central injection wells located at approximately the center of a substantially rectangular modified 5 spot well pattern;

four substantially vertical corner production wells, each located relatively near one of the four corners of the substantially rectangular well pattern; and four substantially horizontal production wells, each horizontal well having one end relatively near the central injection well and the other end located relatively near each of the four corner wells, said wells perforated so that at least 30 feet of distance exists between perforation intervals of different wells.

* * * * *